US006945575B2

(12) United States Patent
Thompson

(10) Patent No.: US 6,945,575 B2
(45) Date of Patent: Sep. 20, 2005

(54) LIFT GATE LATCH

(76) Inventor: David M. Thompson, 802 Mantoloking Rd., Bricktown, NJ (US) 08723

( * ) Notice: Subject to any disclaimer, the term of this patent is extended or adjusted under 35 U.S.C. 154(b) by 0 days.

(21) Appl. No.: 10/830,923

(22) Filed: Apr. 23, 2004

(65) Prior Publication Data

US 2004/0239122 A1 Dec. 2, 2004

Related U.S. Application Data

(63) Continuation of application No. 10/251,054, filed on Sep. 20, 2002, now abandoned.

(51) Int. Cl.[7] ..... E05B 15/02

(52) U.S. Cl. ..... 292/340; 292/1; 114/364; 49/255

(58) Field of Search ..... 292/300, DIG. 15, 292/340, 1; 49/57, 234, 255, 258, 472; 114/364

(56) References Cited

U.S. PATENT DOCUMENTS 119,110 A * 9/1871 Benedict ..... 16/86.2
5,658,119 A * 8/1997 Allsop et al. ..... 414/462
6,192,629 B1 * 2/2001 Akins et al. ..... 49/382
6,311,367 B1 * 11/2001 Larsen ..... 16/375
6,443,088 B1 * 9/2002 Putman et al. ..... 114/343

OTHER PUBLICATIONS

T–H Marine Catalog, p. 24.

* cited by examiner

*Primary Examiner*—Gary Estremsky
(74) *Attorney, Agent, or Firm*—Andrew W. Ludy

(57) ABSTRACT

A lift gate latch is used in connection with a lift gate and a handrail on a boat. The handrail has a jamb, and the lift gate has at least one stile. The lift gate latch has left and right side walls spaced apart and disposed adjacent the deck of the boat. Reinforcing ribs extend along both side walls, which straddle the jamb and the stile. A transverse member and a base member extend between the side walls. A portion of the right side wall has a height lower than the left side wall height, so that the stile can pass easily over it when opening and closing the gate. Fasteners pass through holes in the side walls and attach to the deck. Bosses are juxtaposed with the holes. The fasteners and bosses strengthen the side wall adjacent each hole.

15 Claims, 4 Drawing Sheets

LIFT GATE LATCH

CROSS-REFERENCE TO RELATED APPLICATIONS

This application is a continuation of prior application Ser. No. 10/251,054, filed in the United States on Sep. 20 , 2002, now abandoned. The prior application is expressly incorporated herein by reference.

STATEMENT REGARDING FEDERALLY SPONSORED RESEARCH OR DEVELOPMENT

Not Applicable

BACKGROUND OF THE INVENTION

This invention relates to the field of gates, and more particularly to a lift gate closure latch for a patio boat.

Patio and pontoon boats have greatly increased in number and popularity in recent years. These boats are typically equipped with aluminum handrails along the port and starboard sides, and across the bow and stern. The handrails are usually fastened to the boat deck adjacent the gunwale. The handrails include gates by which to embark and disembark, one on each side and often one forward. These are typically lift gates. A lift gate slides vertically on the same hinges on which it is pivotally mounted. The sliding movement allows a latch to engage as the gate is lowered, in order to secure the gate against opening. Lifting the gate will disengage the latch so that the gate will swing open.

One type of gate latch comprises a hook, or U-shaped element engaging a loop or eye element. The components must first be fabricated. One element is welded or bolted to the gate, and the other to the jamb. This process is labor intensive. The latch rattles when the boat is underway, and it is not very attractive.

Another type of gate latch comprises a generally U-shaped bracket mounted on the boat gunwale. The gate stile fits into the bracket as the gate is lowered. This latch is typically molded of plastic. It has a base portion with the mounting screws, and upright walls, which are prone to breakage.

Accordingly, there is a need to provide a lift gate latch that can be installed quickly and easily with a minimum of skill.

There is a further need to provide a lift gate latch of the type described and that is reinforced so that the walls will not break.

There is a yet further need to provide a lift gate latch of the type described and that will not rattle when the boat is underway.

There is a still further need to provide a lift gate latch of the type described and that will not rust or corrode, and yet is strong and very attractive.

There is another need to provide a lift gate latch of the type described and that can be manufactured cost-effectively in large quantities of high quality.

BRIEF SUMMARY OF THE INVENTION

In accordance with the present invention, there is provided a lift gate latch for use in connection with a lift gate and a handrail on a boat. The boat has a gunwale and a deck, and the handrail has a jamb. The lift gate has a hinge, and at least one stile. The lift gate is able to rise upwardly on the hinge, and is able to pivot on the hinge between a closed and an open position. The lift gate latch comprises a left side wall and a right side wall, the side walls being spaced apart.

Each side wall extends substantially vertically between opposite upper and lower edges. The left side wall has a first hole extending between the upper and lower edges. The first hole passes completely through the lift gate latch. The right side wall has a second hole extending between the upper and lower edges. The second hole passes completely through the lift gate latch The first and second holes are substantially vertical.

A first fastener passes through the first hole to strengthen the left side wall. A second fastener passes through the second hole to strengthen the right side wall. The fasteners engage the deck so as to fasten the lift gate latch to the deck. The metal fasteners pass through the full depth of the walls. They thereby serve to strengthen the side walls, solving a major problem. A first boss protrudes outward from the left side wall, and extends substantially vertically between the upper and lower edges of the left side wall, and is generally aligned axially with the first hole. A second boss protrudes outward from the right side wall, and extends substantially vertically between the upper and lower edges of the right side wall, and is generally aligned axially with the second hole. The bosses strengthen the side wall adjacent each respective hole.

A transverse member extends between the left and right side walls intermediate the first and second ends. The transverse member extends between the upper and lower edges, and is disposed adjacent the jamb. A base member extends transversely between the left and right side walls. Thus, upon opening the lift gate, the lift gate will rise, the stile will pass above the upper edge and the gate will be pivoted open. Upon closing the lift gate, the gate will be pivoted closed, and the stile will pass above the upper edge. The lift gate will then be lowered such that the stile will be captured between the left and right side walls, thereby latching the gate.

BRIEF DESCRIPTION OF THE SEVERAL VIEWS OF THE DRAWING

A more complete understanding of the present invention may be obtained from consideration of the following description in conjunction with the drawing, in which.

DETAILED DESCRIPTION OF THE INVENTION

Figure 1:
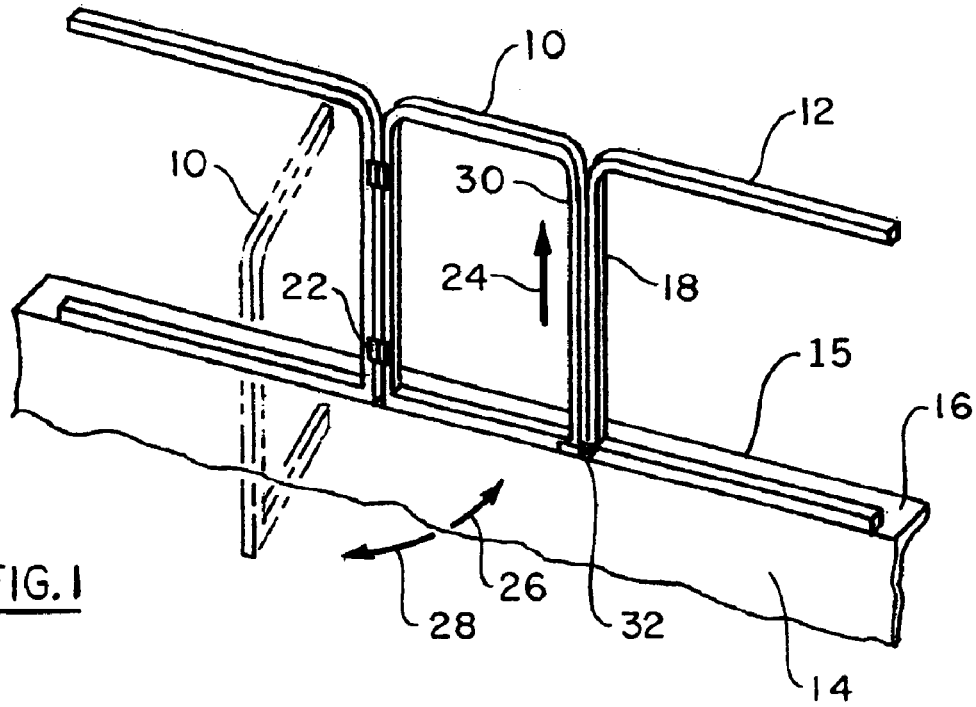
FIG. 1 is a partial, perspective view of a boat gunwale, handrail, gate, and hinge, showing installation of a gate latch constructed in accordance with the invention.
Figure 2:
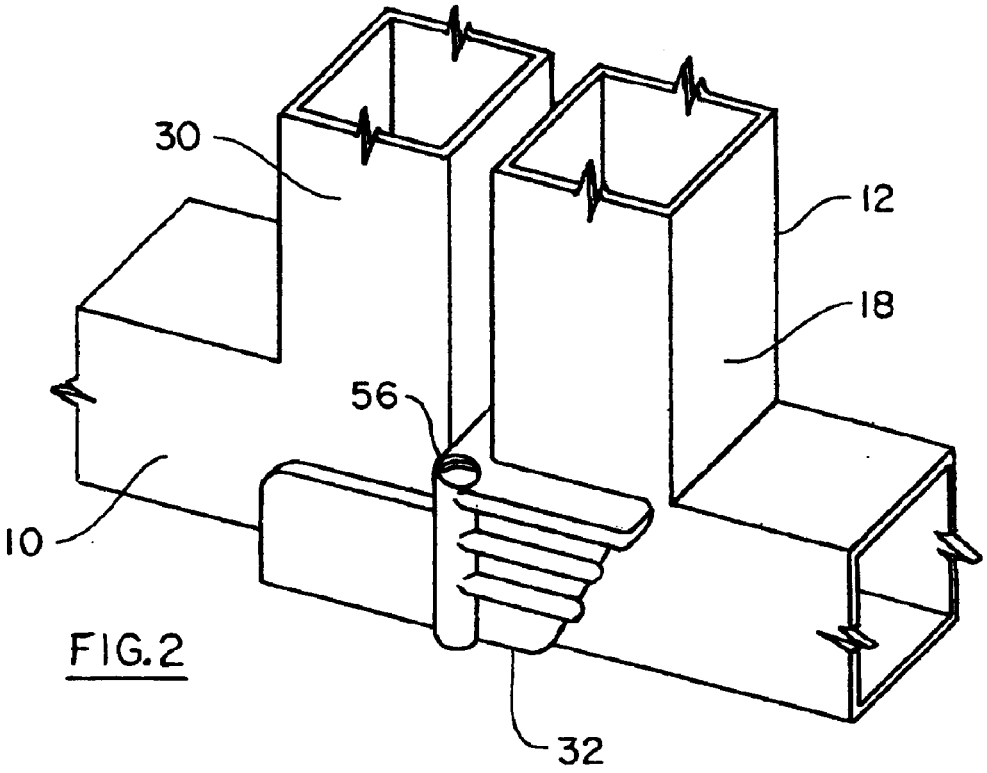
FIG. 2 is a close-up, partial, perspective view of the gate latch installation of FIG. 1.
Figure 6:
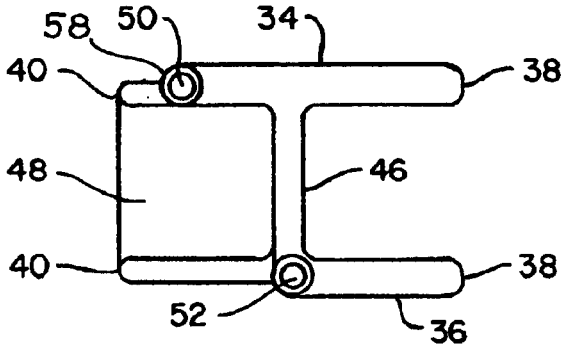
FIG. 6 is a top view of the gate latch of FIG. 1.
Figure 4:
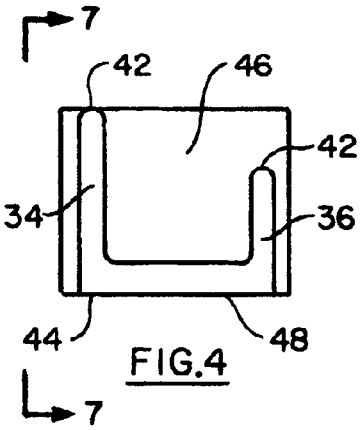
FIG. 4 is a second end elevational view of the gate latch of FIG. 1.
Figure 3:
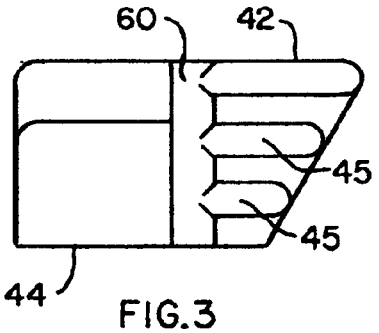
FIG. 3 is a right side elevational view of the gate latch of FIG. 1.
Figure 5:
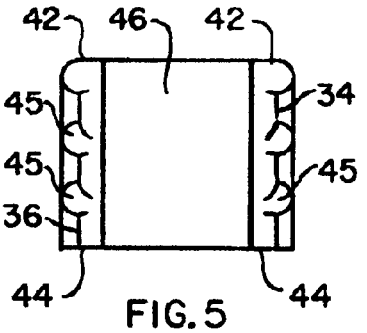
FIG. 5 is a first end elevational view of the gate latch of FIG. 1.
Figure 7:
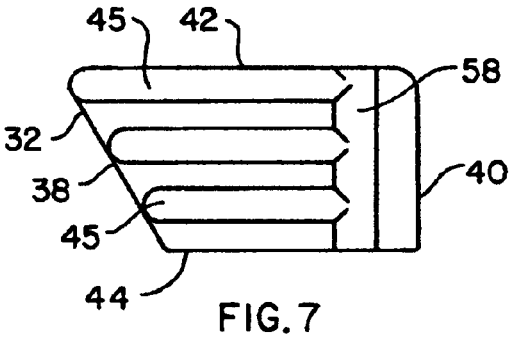
FIG. 7 is a left side elevational view of the gate latch of FIG. 1, taken along lines 7—7 of FIG. 4.
Figure 8:
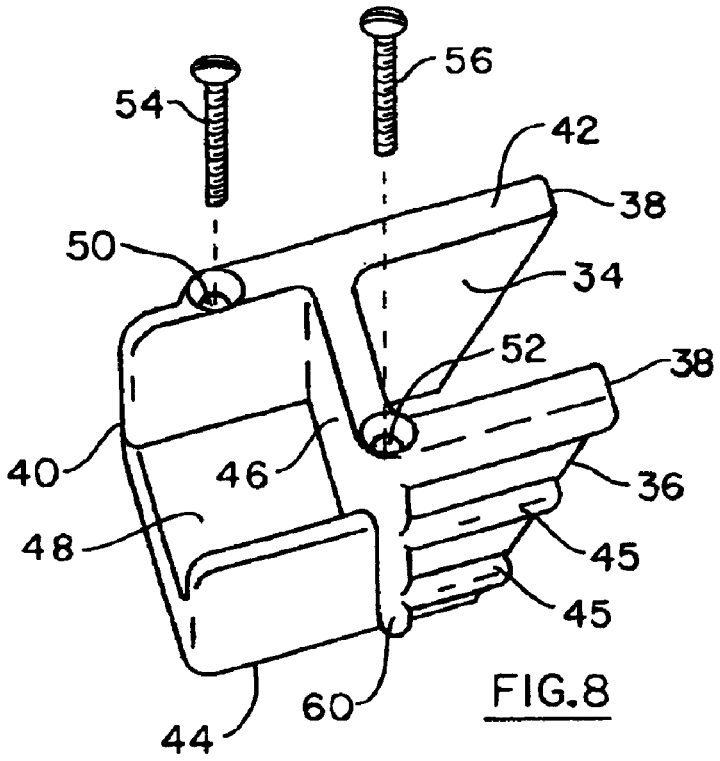
FIG. 8 is a perspective view of the gate latch of FIG. 1.
Figure 14:
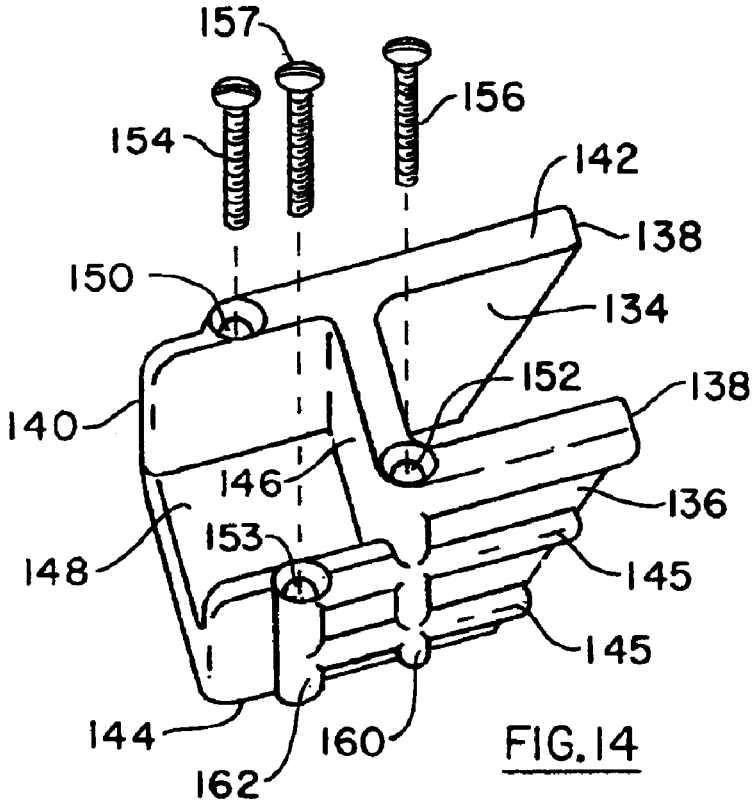
FIG. 14 is a perspective view of the gate latch of FIG. 9.
Figure 12:
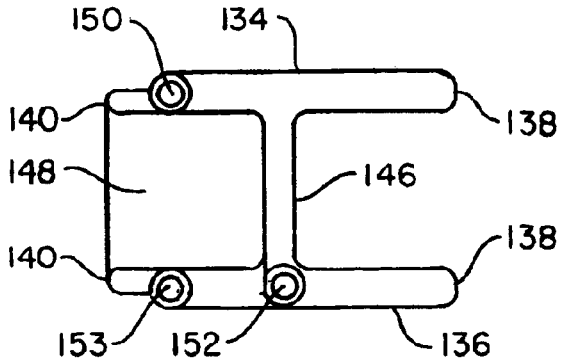
FIG. 12 is a top view of the gate latch of FIG. 9.
Figure 10:
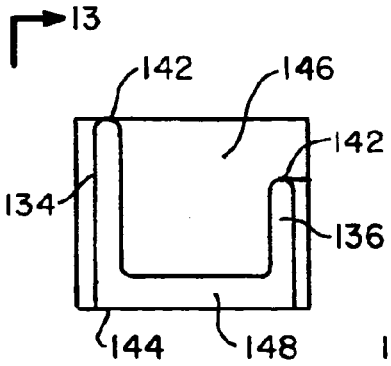
FIG. 10 is a second end elevational view of the gate latch of FIG. 9.
Figure 9:
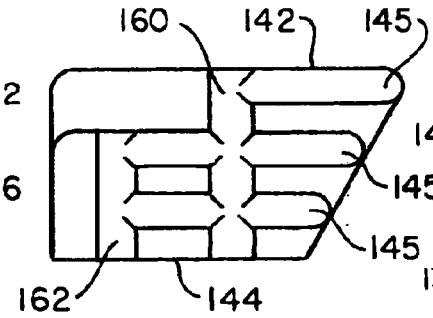
FIG. 9 is a right side elevational view of another gate latch constructed in accordance with the invention.
Figure 11:
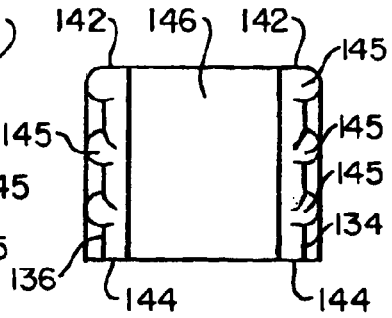
FIG. 11 is a first end elevational view of the gate latch of FIG. 9.
Figure 13:
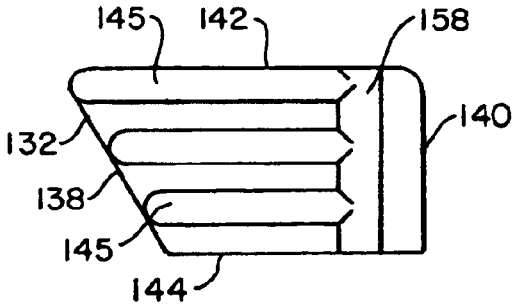
FIG. 13 is a left side elevational view of the gate latch of FIG. 9, taken along lines 13—13 of FIG. 10.

Referring now to the drawing and especially to FIGS. 1 and 2 thereof, a lift gate latch is shown at 32, and is for use in connection with a lift gate 10 and a handrail 12 on a boat 14. The boat 14 has a deck 15 and a gunwale 16. The handrail 12 has a jamb 18. The lift gate 10 has a hinge 22. The lift gate 10 is able to rise upwardly on the hinge 22, as shown by arrow 24. The lift gate 10 is able to pivot on the hinge 22 between a closed and an open position, shown by arrows 26 and 28 respectively. The lift gate 10 has at least one stile 30.

Turning now to FIGS, 3,4,5,6,7, and 8, as well as FIGS. 1 and 2, the lift gate latch 32 comprises a left side wall 34 and a right side wall 36. Each side wall extends substantially horizontally between opposite first 38 and second 40 ends, and substantially vertically between opposite upper 42 and lower 44 edges. Reinforcing ribs 45 extend along the left 34 and right 36 side walls to strengthen the side walls. The upper edges 42 are at a predetermined height above the lower edges 44. The side walls 34 and 36 are parallel and spaced apart. The left 34 and right 36 side walls straddle the jamb 18 and the stile 30, as shown in FIG. 2. The left and right side wall lower edges 44 are disposed adjacent the deck 15. A transverse member 46 extends transversely between the left 34 and tight 36 side walls intermediate the first 38 and second 40 ends. The transverse member 46 extends substantially vertically between the upper 42 and lower 44 edges. The transverse member 46 is disposed adjacent the jamb 18. The right side wall upper edge 42 between the transverse member 46 and the second end 40 has a height lower than the predetermined height, so as to facilitate passing of the stile 18 above the upper edge 42. A base member 48 extends between the left 34 and right 36-side walls, and extends from the transverse member 46 to the first end 38. The base member 48 is disposed adjacent the deck 15. The lift gate latch 32 typically will be injection molded from a thermoplastic or thermoset resin.

The left side wall 34 includes a first hole 50 extending between the upper 42 and lower 44 edges. The right side wall 36 includes a second hole 52 extending between the upper 42 and lower 44 edges. The first 50 and second 52 holes pass completely through the lift gate latch 32, and are substantially vertical. A first fastener 54 passes through the first hole 50, thereby strengthening the left side wall 34. The first fastener 54 penetrates the deck 15 and is attached to the deck 15. A second fastener 56 passes through the second hole 52, thereby strengthening the right side wall 36. The second fastener 56 penetrates the deck 15 and is attached to the deck 15. In this manner, the first 54 and second 56 fasteners attach the lift gate latch 32 to the deck 15. The fasteners 54 and 56 typically will be machine screws secured with nuts and washers (not shown) under the deck 15. A first boss 58 protrudes outward from the left side wall 34. The first boss 58 extends substantially vertically between the upper 42 and lower 44 edges of the left side wall 34 and is generally aligned axially with the first hole 50. A second boss 60 protrudes outward from the right side wall 36. The second boss 60 extends substantially vertically between the upper 42 and lower 44 edges of the right side wall 36 and is generally aligned axially with the second hole 52. The first 58 and second 60 bosses strengthen the side wall adjacent each respective hole.

Thus, upon opening the lift gate 10, the lift gate 10 will rise, the stile 30 will pass above the upper edge 42 and the gate 10 will be pivoted open. Conversely, upon closing the lift gate 10, the gate 10 will be pivoted closed, the stile 30 will pass above the upper edge 42, and the lift gate 10 will be lowered such that the stile 30 will be captured between the left 34 and right 36 side walls, thereby securely latching the gate 10.

Referring now to FIGS. 9,10,11,12,13, and 14, another embodiment of the lift gate latch is shown at 132. Latch 132 is similar to latch 32, in that it comprises a left side wall 134 and a right side wall 136. Each side wall extends substantially horizontally between opposite first 138 and second 140 ends, and substantially vertically between opposite upper 142 and lower 144 edges. Reinforcing ribs 145 extend along the left 134 and right 136 side walls to strengthen the side walls. The upper edges 142 are at a predetermined height above the lower edges 144. The side walls 134 and 136 are parallel and spaced apart. A transverse member 146 extends between the left 134 and right 136 side walls intermediate the first 138 and second 140 ends. The transverse member 146 extends between the upper 142 and lower 144 edges. The right side wall upper edge 142 between the transverse member 146 and the second end 140 has a height lower than the predetermined height, so as to facilitate passing of the stile 18 above the upper edge 142. A base member 148 extends between the left 134 and right 136 side walls, and extends from the transverse member 146 to the first end 138.

The left side wall 134 includes a first hole 150 extending between the upper 142 and lower 144 edges. The right side wall 136 includes a second hole 152 extending between the upper 142 and lower 144 edges. The first 150 and second 152 holes pass completely through the lift gate latch 132, and are substantially vertical. A first fastener 154 passes through the first hole 150, thereby strengthening the left side wall 134. The first fastener 154 penetrates the deck 15 and is attached to the deck 15. A second fastener 156 passes through the second hole 152, thereby strengthening the right side wall 136. The second fastener 156 penetrates the deck 15 and is attached to the deck 15. Thus, the first 154 and second 156 fasteners attach the lift gate latch 132 to the deck 15. A first boss 158 protrudes outward from the left side wall 134. The first boss 158 extends substantially vertically between the upper 142 and lower 144 edges of the left side wall 134 and is generally aligned axially with the first hole 150. A second boss 160 protrudes outward from the right side wall 136. The second boss 160 extends substantially vertically between the upper 142 and lower 144 edges of the right side wall 136 and is generally aligned axially with the second hole 152. The first 158 and second 160 bosses strengthen the side wall adjacent each respective hole.

Latch 132 differs from latch 32, in that the right side wall 136 also includes a third hole 153 extending between the upper 142 and lower 144 edges adjacent the second end 140. The third hole 153 passes completely through the lift gate latch 132, and is substantially vertical. A third fastener—157 passes through the third hole 153, thereby strengthening the right side wall 136. The third fastener 157 penetrates the deck 15 and is attached to the deck 15. A third boss 162 protrudes outward from the right side wall 136. The third boss 162 extends substantially vertically between the upper 142 and lower 144 edges of the right side wall 136 and is generally aligned axially with the third hole 153.

A strengthening method is also disclosed for strengthening a lift gate latch. The method comprises the steps of extending a left side wall 134 and a right side wall 136 between opposite first 138 and second 140 ends, and between opposite upper 142 and lower 144 edges. Next, spacing the side walls apart and parallel. Next, extending a base member 148 transversely between the left 134 and right 136 side walls. Next, extending a substantially vertical first hole 150 between the upper 142 and lower 144 edges of the left side wall 134, and passing the first hole 150 completely through the lift gate latch 132. Similarly, extending a substantially vertical second hole 152 between the upper 142 and lower 144 edges of the right side wall 136, and passing the second hole 152 completely through the lift gate latch 132.

Further steps comprise extending a transverse member 146 between the left 134 and right 136 side walls, disposing the transverse member 146 adjacent the jamb 18, and intermediate the first 138 and second 140 ends, and extending the transverse member 146 between the upper 142 and lower 144 edges, then extending the base member 148 from the transverse member 146 to the first end 138. Next, protruding a first boss 158 outward from the left side wall, then extending the first boss 158 substantially vertically between the upper 142 and lower 144 edges of the left side wall 134. Then aligning the first boss 158 generally axially with the first hole 150, and strengthening the left side wall 34 adjacent the first hole 150 with the first boss 158. Next, protruding a second boss 160 outward from the right side wall, then extending the second boss 160 substantially vertically between the upper 142 and lower 144 edges of the right side wall 136, aligning the second boss 160 generally axially with the second hole 152, and strengthening the right side wall 136 adjacent the second hole 152 with the second boss 160.

Yet further steps include extending a substantially vertical third hole 153 through the right side wall 136 between the upper 142 and lower 144 edges of the right side wall 136 adjacent the second end 140, and passing the third hole 153 completely through the lift gate latch 132. Next, protruding a third boss 162 outward from the right side wall 136, then extending the third boss 162 substantially vertically between the upper 142 and lower 144 edges of the right side wall 136, then aligning the third boss 162 generally axially with the third hole 153, and strengthening the right side wall 136 adjacent the third hole 153 with the third boss 162. Next, passing a third fastener 157 through the third hole 153, then penetrating the deck with the third fastener, then attaching the third fastener to the deck, and strengthening the right side wall 136 with the third fastener 157. Fastening the lift gate latch 132 to the deck 15 is enhanced with the third fastener 157. A final step includes extending reinforcing ribs 145 along the left 134 and right 136 side walls, so as to strengthen the walls.

Numerous modifications and alternative embodiments of the invention will be apparent to those skilled in the art in view of the foregoing description Accordingly, this description is to be construed as illustrative only and is for the purpose of teaching those skilled in the art the best mode of carrying out the invention. Details of the structure may be varied substantially without departing from the spirit of the invention and the exclusive use of all modifications that will come within the scope of the appended claims is reserved.

What is claimed is:

1. A lift gate latch, for use in connection with a lift gate and a handrail on a boat, the boat having a gunwale and a deck, the handrail having a jamb, the lift gate having a hinge, the lift gate being able to rise upwardly on the hinge, the lift gate being able to pivot on the hinge between a closed and an open position, the lift gate having at least one stile, the lift gate latch comprising:

(a) a left side wall and a right side wall, each side wall extending substantially vertically between opposite upper and lower edges, the left side wall having a first hole extending substantially vertically between the upper and lower edges, the first hole passing completely through the lift gate latch, and the right side wall having a second hole extending substantially vertically between the upper and lower edges, the second hole passing completely through the lift gate latch;

(b) a first boss protruding outward from the left side wall and extending substantially vertically between the upper and lower edges of the left side wall, the first boss being generally aligned axially with the first hole, and a second boss protruding outward from the right side wall and extending substantially vertically between the upper and lower edges of the right side wall, the second boss being generally aligned axially with the second hole, so as to strengthen the side wall adjacent each hole; and (c) a base member extending transversely between the left and right side walls.

2. The lift gate latch of claim 1, wherein the left and right side walls are spaced apart and straddle the jamb and the stile, and the left and right side wall lower edges are disposed adjacent the deck.

3. The lift gate latch of claim 2, further comprising:

(a) a transverse member extending transversely between the left and right side walls intermediate the first and second ends, and extending substantially vertically between the upper and lower edges, the transverse member being disposed adjacent the jamb; and (b) a first fastener passing through the first hole, thereby strengthening the left side wall, the first fastener penetrating the deck and being attached to the deck, and a second fastener passing through the second hole, thereby strengthening the right side wall, the second fastener penetrating the deck and being attached to the deck, so as to attach the lift gate latch to the deck, so that upon opening the lift gate, the lift gate will rise, the stile will pass above the upper edge and the gate will be pivoted open, and upon closing the lift gate, the gate will be pivoted closed, the stile will pass above the upper edge, and the lift gate will be lowered such that the stile will be captured between the left and right side walls, thereby latching the gate.

4. The lift gate latch of claim 3, further comprising reinforcing ribs extending along the left and right side walls to strengthen the side walls.

5. The lift gate latch of claim 3, wherein:

(a) the right side wall includes a third hole extending substantially vertically between the upper and lower edges adjacent the second end; the third hole passing completely through the lift gate latch;

(b) the right side wall includes a third boss protruding outward from the right side wall and extending substantially vertically between the upper and lower edges of the right side wall, the third boss being generally aligned axially with the third hole to strengthen the right side wall adjacent the third hole; and (c) the lift gate latch includes a third fastener passing through the third hole thereby strengthening the right side wall, the third fastener penetrating the deck and being attached to the deck, so as to attach the lift gate latch to the deck.

6. The lift gate latch of claim 3, wherein the right side wall upper edge between the transverse member and the second end has a height lower than the predetermined height, so as to facilitate passing of the stile above the upper edge.

7. A lift gate latch, for use in connection with a lift gate and a handrail on a boat, the boat having a gunwale and a deck, the handrail having a jamb, the lift gate having a hinge, the lift gate being able to rise upwardly on the hinge, the lift gate being able to pivot on the hinge between a closed and an open position, the lift gate having at least one stile, the lift gate latch comprising:

(a) a left side wall and a right side wall, each side wall extending substantially horizontally between opposite first and second ends, and substantially vertically between opposite upper and lower edges, the upper edges being a predetermined height above the lower edges, the left and right side walls being parallel, spaced apart, and straddling the jamb and the stile, the left and right side wall lower edges being disposed adjacent the deck, the left side wall having a first hole extending substantially vertically between the upper and lower edges, the first hole passing completely through the lift gate latch, and the right side wall having a second hole extending substantially vertically between the upper and lower edges, the second hole passing completely through the lift gate latch;

(b) a first boss protruding outward from the left side wall and extending substantially vertically between the upper and lower edges of the left side wall, the first boss being generally aligned axially with the first hole, and a second boss protruding outward from the right side wall and extending substantially vertically between the upper and lower edges of the right side wall, the second boss being generally aligned axially with the second hole, so as to strengthen the side wall adjacent each hole;

(c) a first fastener passing through the first hole, thereby strengthening the left side wall, the first fastener penetrating the deck and being attached to the deck and a second fastener passing through the second hole, thereby strengthening the right side wall, the second fastener penetrating the deck and being attached to the deck, so as to attach the lift gate latch to the deck;

(d) a base member extending between the left and right side walls, and extending from the transverse member to the first end, the base member being disposed adjacent the deck; and (e) a transverse member extending transversely between the left and right side walls intermediate the first and second ends, and extending substantially vertically between the upper and lower edges, the transverse member being disposed adjacent the jamb, so that upon opening the lift gate, the lift gate will rise, the stile will pass above the upper edge and the gate will be pivoted open, and upon closing the lift gate, the gate will be pivoted closed, the stile will pass above the upper edge, and the lift gate will be lowered such that the stile will be captured between the left and right side walls, thereby latching the gate.

8. The lift gate latch of claim 7, further comprising reinforcing ribs extending along the left and right side walls to strengthen the side walls.

9. The lift gate latch of claim 7, wherein:

(a) the right side wall includes a third hole extending substantially vertically between the upper and lower edges adjacent the second end; the third hole passing completely through the lift gate latch;

(b) the right side wall includes a third boss protruding outward from the right side wall and extending substantially vertically between the upper and lower edges of the right side wall, the third boss being generally aligned axially with the third hole to strengthen the right side wall adjacent the third hole; and (c) the lift gate latch includes a third fastener passing through the third hole thereby strengthening the right side wall, the third fastener penetrating the deck and being attached to the deck, so as to attach the lift gate latch to the deck.

10. The lift gate latch of claim 9, wherein the right side wall upper edge between the transverse member and the second end has a height lower than the predetermined height, so as to facilitate passing of the stile above the upper edge.

11. A method for strengthening a lift gate latch, for use in connection with a lift gate and a handrail on a boat, the boat having a gunwale and a deck, the handrail having a jamb, the lift gate having a hinge, the lift gate being able to rise upwardly on the hinge, the lift gate being able to pivot on the hinge between a closed and an open position, the lift gate having at least one stile, the method comprising the steps of:

(a) extending a left side wall and a right side wall between opposite first and second ends, and between opposite upper and lower edges;

(b) spacing the side walls apart and parallel;

(c) extending a base member transversely between the left and right side walls;

(d) extending a substantially vertical first hole through the left side wall, between the upper and lower edges of the left side wall;

(e) passing the first hole completely through the lift gate latch;

(f) extending a substantially vertical second hole through the right side wall, between the upper and lower edges of the right side wall;

(g) passing the second hole completely through the lift gate latch;

(h) protruding a first boss outward from the left side wall;

(i) extending the first boss substantially vertically between the upper and lower edges of the left side wall;

(j) aligning the first boss generally axially with the first hole;

(k) strengthening the left side wall adjacent the first hole with the first boss;

(l) protruding a second boss outward from the right side wall;

(m) extending the second boss substantially vertically between the upper and lower edges of the right side wall;

(n) aligning the second boss generally axially with the second hole; and (o) strengthening the right side wall adjacent the second hole with the second boss.

12. The strengthening method of claim 11, further comprising the steps of:

(a) extending a transverse member between the left and right side walls;

(b) disposing the transverse member adjacent the jamb intermediate the first and second ends;

(c) extending the transverse member between the upper and lower edges; and (d) extending the base member from the transverse member to the first end.

13. The strengthening method of claim 12, further comprising the steps of:

(a) straddling the jamb and the stile with the left and right side walls;

(b) disposing the left and right side wall lower edges adjacent the deck;

(c) disposing the base member adjacent the deck;

(d) passing a first fastener through the first hole;

(e) penetrating the deck with the first fastener;

(f) attaching the first fastener to the deck;

(g) strengthening the left side wall with the first fastener;

(h) passing a second fastener through the second hole;

(i) penetrating the deck with the second fastener;

(j) attaching the second fastener to the deck;

(k) strengthening the right side wall with the second fastener; and (l) fastening the lift gate latch to the deck with the first and second fasteners.

14. The strengthening method of claim 13, further comprising the steps of:

(a) extending a substantially vertical third hole through the right side wall, between the upper and lower edges of the right side wall adjacent the second end;

(b) passing the third hole completely through the lift gate latch;

(c) protruding a third boss outward from the left side wall;

(d) extending the third boss substantially vertically between the upper and lower edges of the right side wall;

(e) aligning the third boss generally axially with the third hole;

(f) strengthening the right side wall adjacent the third hole with the third boss;

(g) passing a third fastener through the third hole;

(h) penetrating the deck with the third fastener;

(i) attaching the third fastener to the deck;

(j) strengthening the right side wall with the third fastener; and (k) fastening the lift gate latch to the deck with the third fastener.

15. The strengthening method of claim 13, further comprising the steps of (a) extending reinforcing ribs along the left and right side walls; and (b) strengthening the walls with the reinforcing ribs.

* * * * *